US006173535B1

(12) United States Patent
Deischl et al.

(10) Patent No.: US 6,173,535 B1
(45) Date of Patent: Jan. 16, 2001

(54) OPENING ARRANGEMENT FOR A VEHICLE DOOR

(75) Inventors: Hans Deischl, Jettingen; Juergen Jooss; Rudi Koelle, both of Sindelfingen; Martin Lindmayer, Sulz, all of (DE)

(73) Assignee: DaimlerChrysler AG, Stuttgart (DE)

( * ) Notice: Under 35 U.S.C. 154(b), the term of this patent shall be extended for 0 days.

(21) Appl. No.: 09/411,202

(22) Filed: Oct. 4, 1999

(30) Foreign Application Priority Data

Oct. 2, 1998 (DE) ..... 198 45 393

(51) Int. Cl.[7] ..... E06B 3/00

(52) U.S. Cl. ..... 49/503; 292/DIG. 31; 292/DIG. 53

(58) Field of Search ..... 49/503; 292/DIG. 31, 292/DIG. 53; 70/208, 451, 466

(56) References Cited

U.S. PATENT DOCUMENTS 5,377,450 * 1/1995 Varajon ..... 49/502
5,884,434 * 3/1999 Dedrich et al. ..... 49/503

FOREIGN PATENT DOCUMENTS

19524568A1 12/1996 (DE) .
19635948A1 3/1997 (DE) .

OTHER PUBLICATIONS

1779304, Wilhelm Friedrich Kiekert, Heiligenhaus Bez. Duesseldorf, Ratinger Strasse 5a., Dec. 11, 1958.

* cited by examiner

*Primary Examiner*—Jerry Redman
(74) *Attorney, Agent, or Firm*—Evenson, McKeown, Edwards & Lenahan, P.L.L.C.

(57) ABSTRACT

An opening arrangement is known for a vehicle door has a door lock which can be operated by an exterior door grip arranged on the outside on the exterior vehicle shell, which exterior door grip is movably disposed by a bearing bow fixed on the interior side on the exterior door shell. The bearing bow is supported on an end area, viewed in the longitudinal direction of the vehicle, by way of at least one deformation-resistant torsion support on the interior door shell and is fixed on the opposite end area, viewed in the longitudinal direction of the vehicle, on a door-fixed support part.

19 Claims, 2 Drawing Sheets

OPENING ARRANGEMENT FOR A VEHICLE DOOR

BACKGROUND AND SUMMARY OF THE INVENTION

This application claims the priority of German application 198 45 393.0, filed in Germany on Oct. 2, 1998, the disclosure of which is expressly incorporated by reference herein.

The invention relates to an opening arrangement for a vehicle door, having an exterior door shell as well as an interior door shell and having a door lock which can be operated by means of an exterior door grip arranged on the outside on the exterior door shell, which exterior door grip is movably disposed by means of a bearing bow fixed on the interior side on the exterior door shell.

Such an opening arrangement for a vehicle door is generally known in the case of passenger cars. The vehicle door of such a passenger car is composed of an outer covering forming the exterior door shell as well as of a door plate forming the interior door shell. In a known manner, the vehicle door also has a door lock which is arranged opposite a hinge arrangement on the vehicle door and can be operated from the outside by means of an exterior door grip. In the case of such a passenger car, the exterior door grip is preferably arranged on a—viewed in the longitudinal direction of the vehicle—rearward door section and is designed as a pull grip. The further development as a pull grip permits an opening of the vehicle door by a corresponding pulling movement. For the bearing of the exterior door grip on the exterior door shell, a bearing bow is fixed on the interior side on the exterior door shell. Corresponding passages are provided in the exterior door shell which permit the passing through of corresponding partial sections of the exterior door grip for its bearing.

It is an object of the invention to provide an opening arrangement of the initially mentioned type which, in the event of an intrusion of the vehicle door because of a vehicle impact, reduces the risk of an unintentional opening of the vehicle door.

This object is achieved according to preferred embodiments of the invention in that the bearing bow is supported at the level of an end area of the exterior door grip, viewed in the longitudinal direction of the vehicle, by way of at least one deformation-resistant torsion support on the interior door shell, and is fixed at the level of the end area of the exterior door grip situated on the opposite side in the longitudinal direction of the vehicle on a door-fixed support part, particularly the door lock.

As the result of the solution according to the invention, it is possible to prevent a torsion of the bearing bow and therefore also a torsion of the exterior door grip. The invention is based on the recognition that, in the case of known vehicle doors, corresponding door intrusions resulted in torsions of the exterior door grip which lead to an unintentional triggering of the door lock and therefore in an unintentional opening of the vehicle door. One securing section of the bearing bow at the level of one end area of the exterior door grip is preferably held by means of a bearing pin in a stable manner in a lock carrier of the door lock which is connected with the interior door plate. The correspondingly adjacent other securing section of the bearing bow at the level of the end area of the exterior door grip situated on the opposite side in the longitudinal direction of the vehicle is connected by the at least one torsion support with the interior door plate, that is, the interior door shell. In addition to avoiding torsions in the triggering direction of the exterior door grip, which may lead to an unintentional and automatic opening of the vehicle door, the solution according to the invention reduces the intrusion of the vehicle door in the entire area of the exterior door grip.

As a further development of preferred embodiments of the invention, the torsion support on the bearing bow is disposed by means of a supporting section which permits at least two different supporting angles relative to the bearing bow. As a result, it is conceivable to arrange the torsion support in differently diagonal alignments with respect to the bearing bow. This further development particularly permits the use of an identically constructed torsion support in the area of a right as well as of a left vehicle door.

In a further development of preferred embodiments of the invention, the torsion support has two supporting heads which are aligned with one another in a fork-type manner and of which one is provided for the arrangement of the torsion support in a left vehicle door and the other is provided for the arrangement in a right vehicle door. This further development permits also for the front side of the torsion support facing the interior door shell the identically constructed use of torsion supports in the case of the left as well as the right vehicle door.

As a further development of preferred embodiments of the invention, the torsion support is oriented to be inclined once or several times in the space. As a result, it is possible to use a corresponding torsion support for achieving the desired securing function also in the case of more complicated spatial designs of the interior door shell and/or the bearing bow.

Other objects, advantages and novel features of the present invention will become apparent from the following detailed description of the invention when considered in conjunction with the accompanying drawings.

DETAILED DESCRIPTION OF THE INVENTION

Figure 1:
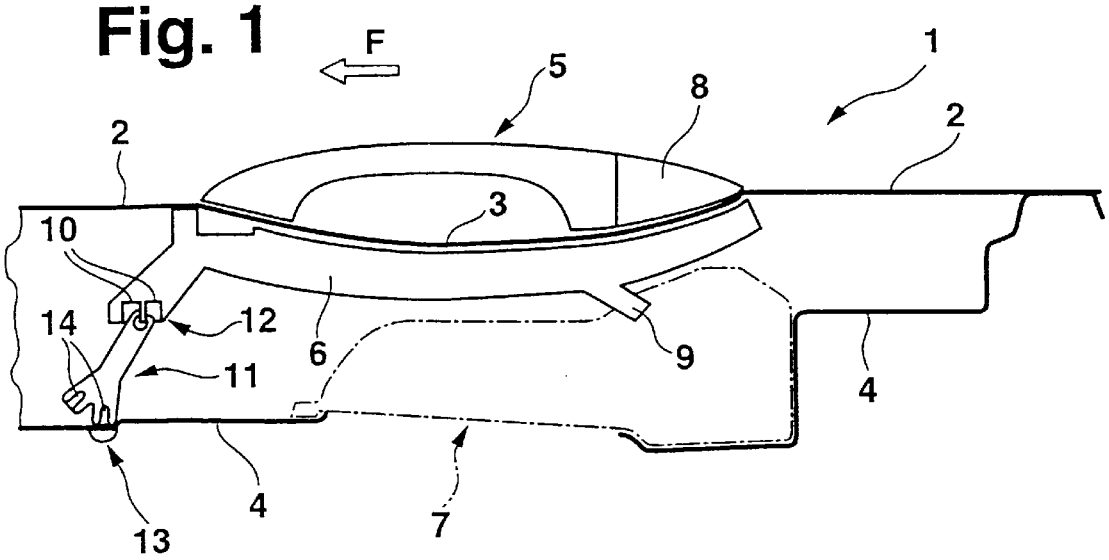
FIG. 1 is a schematic horizontal longitudinal sectional view of a vehicle door of a passenger car in the area of an embodiment of an opening arrangement according to the invention.
Figure 2:
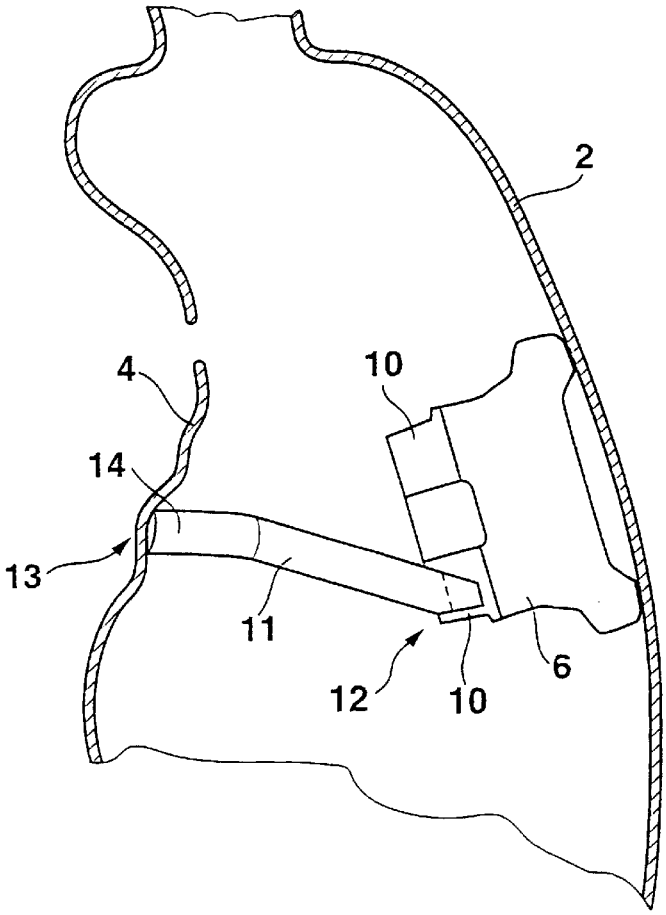
FIG. 2 is an enlarged and schematic vertical cross-sectional view of the vehicle door and arrangement of FIG. 1, in which an exterior door grip of the opening arrangement is not shown.

In a known manner, a passenger car has in each case at least one vehicle door 1 on each vehicle side, which vehicle door 1 is provided with an opening arrangement according to FIGS. 1 and 2. On the body shell side, each vehicle door 1 is composed of an interior door plate 4 serving as the interior door shell as well as of an outer covering 2 serving as the exterior door shell, which are fixedly connected with one another in their edge areas while forming a shell-type hollow body. Approximately at the level of a belt line of the passenger car or above this belt line, an indentation in the form of a grip depression 3 is provided in the outer covering 2 according to FIG. 1, in which grip depression 3 the exterior door grip 5 is positioned. The exterior door grip 5 is part of a grip arrangement which, on the exterior side of the door, also has a lock receiving section 8 for accommodating a lock cylinder. On the interior side, the grip arrangement has a basically known bearing bow 6 which is designed in the shape of a frame or carrying plate and which rests from the inside on the outer covering 2 and on which the lock receiving section 8 and the exterior door grip 5 are positioned. The exterior door grip 5 is designed as a pull grip and, on its forward end viewed in the driving direction F, is swivellably disposed in the bearing bow 6. In a manner not shown in detail, the rear-side end of the exterior door grip 5 is led through the outer covering 2 to the inside and is applied to a lock triggering lever of a door lock unit 7.

By means of a lock carrier, which is not shown in detail, the door lock unit 7 is fixed on the interior door plate 4. The operation of the door lock unit 7 as well as the basic construction of the door lock unit 7 correspond to the state of the art so that the door lock unit 7 including its arrangement in the area of the interior door plate 4 does not have to be discussed here in detail.

The bearing bow 6, which is constructed as a one-piece plastic component, has, at the level of it rearward—relative to the normal driving direction F—end area of the exterior door grip 5, by means of which the exterior door grip 5, in a manner not shown in detail, is applied to the lock triggering lever of the door lock unit 7, a pin-shaped bearing extension 9, which is held in the lock carrier of the door lock unit 7. This area of the bearing bow 6 therefore forms a first securing section. The bearing bow 6 has a mirror-symmetrical construction, in which case the bearing extension 9 is situated at half the height in its center, in order to be able to use such a bearing bow 6 for a right as well as for a left vehicle door. The bearing bow 6 is therefore connected in its rearward securing section in a stable manner with the door lock unit 7 and thus with the interior door plate 4.

Figure 4:
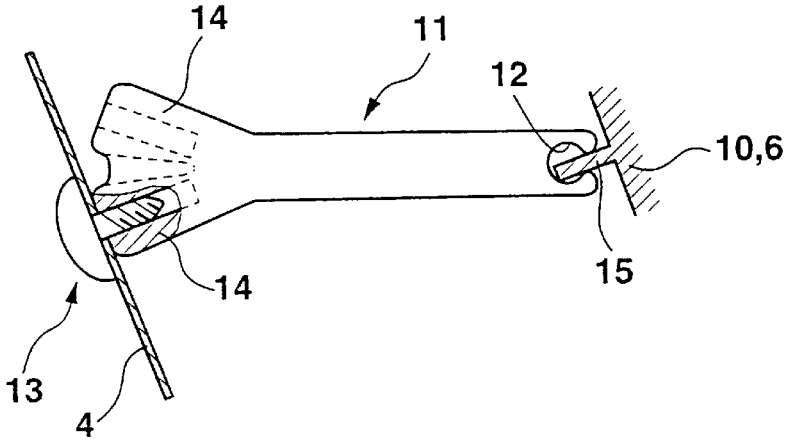
FIG. 4 is a schematic representation of the arrangement of the torsion strut according to FIG. 3 inside the vehicle door according to FIGS. 1 and 2.
Figure 5:
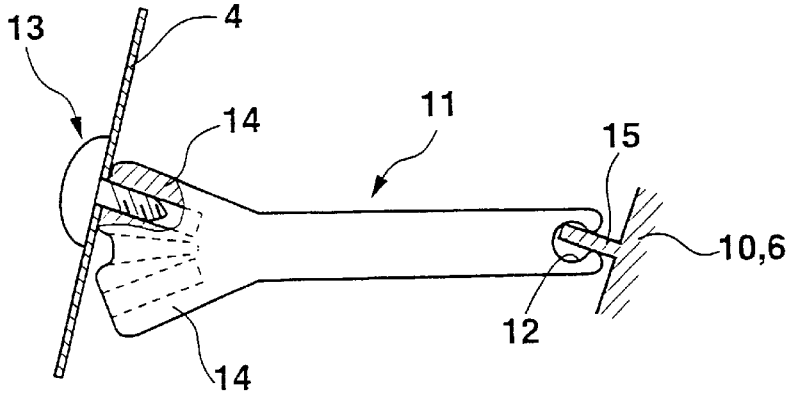
FIG. 5 is a view of an arrangement of the torsion strut according to FIG. 3 or 4 in a vehicle door situated opposite the vehicle door according to FIG. 4.

On an opposite forward securing section, which is situated at the level of a forward end area of the exterior door grip 6 and thus approximately at the level of its swivel bearing, the bearing bow 6 has a receiving extension which is provided on its top side as well as on its bottom side (FIG. 2) in each case with a receiving device 10 for holding a torsion strut 11 used as the torsion support. In each receiving device 10, a holding web 15 (FIGS. 4 and 5) is arranged, a supporting eye 12 of the torsions strut 11, which is used as a supporting section, extending over the holding web 15. The supporting eye 12 is provided on a frontal end of the torsion strut 11 facing the bearing bow 6 and, according to FIGS. 4 and 5, is designed such that the holding web 15 can be accommodated by the supporting eye 12 in different angular positions.

The torsion strut 11 is constructed to be deformation-resistant and is preferably produced from a suitable metal alloy. However, it may also be made of plastic, preferably with a corresponding fiber reinforcement.

Figure 3:
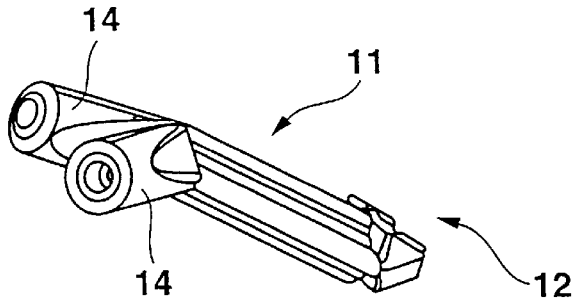
FIG. 3 is a perspective view of a torsion strut of the opening arrangement according to FIGS. 1 and 2, which torsion strut is used as the torsion support.

According to FIG. 3, the torsion strut 11 is twice inclined in the space in order to achieve a supporting of torsion forces which would cause a movement of the exterior door grip and therefore a triggering of the lock operating lever. For this purpose, the torsion strut 11 with its supporting eye 12 is in each case applied to the lower receiving device 10 of the bearing bow 6. The respective upper receiving device 10 of the bearing bow 6 has no function. It would be used for receiving a corresponding supporting eye if the bearing bow 6 were to be used in the case of a vehicle door on an opposite vehicle side. This symmetrical design of the bearing bow 6 was selected so that bearing bows 6 of different designs are not required for the left and the right vehicle side.

The same applies to the torsion strut 11 which, on one frontal end, is provided with the supporting eye 12 and, on its other frontal end, is provided with two supporting heads 14 which are aligned with respect to one another in a fork shape or in a V-shape. Only one of the two supporting heads 14 respectively is required on a vehicle side in order to fix the torsion strut 11 in a force-transmitting manner on the interior door plate 4 by means of a screwed connection 13 or differently designed fastening elements. The two supporting heads 14 are angularly aligned with one another such that each of the two supporting heads 14 is in each case assigned to a positioning on the right or left vehicle side and is suitable for this purpose. The respective other supporting head 14 thus remains without a holding function.

In the event of an intrusion of the outer covering 2 in the transverse direction of the vehicle toward the inside, that is, particularly in the event of a side impact or also in the event of an upsetting of the vehicle door because of a frontal or rear impact, the outer covering 2 below the grip depression 3 is pressed toward the inside. On the rearward securing section of the bearing bow 6, a relatively stable supporting takes place by means of the bearing extension 9 in the lock carrier of the door lock unit 7, so that, in the door grip area, the outer covering 2 experiences no or almost no deformation at this point. In contrast, on the forward securing section of the bearing bow 6, an intrusion of the outer covering 2 could result in a torsion of the bearing bow 6 in this securing section in comparison to the rearward fixed securing section. In order to avoid such a torsion, the torsion strut 11 is provided. According to FIG. 2, it is applied to a lower corner section of the forward securing section of the bearing bow 6 and thus counteracts at an early point in time the corresponding torsion forces because of intrusions of the outer covering 2. In this case, the torsion forces are transmitted to the interior plate 4, whereby the entire interior door plate 4 can contribute to reducing energy. Thus, the torsion strut 11 simultaneously also reduces overall intrusions in the area of the grip depression 3 of the outer covering 2. Since no torsions occur of the bearing bow 6, as the result of corresponding torsion forces, the exterior door grip 5 can also not be pressed to the outside, so that it can be avoided that the latter triggers the lock operating lever for opening the door lock unit 7 and thus the vehicle door.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Opening arrangement for a vehicle door, having an exterior door shell as well as an interior door shell and having a door lock which can be operated by an exterior door grip arranged on the outside on the exterior door shell, which exterior door grip is movably disposed by a bearing bow fixed on the interior side on the exterior door shell, wherein the bearing bow is supported on the interior door shell proximal to a first end area of the exterior door grip, viewed in a longitudinal direction of a vehicle, by way of at least one deformation-resistant torsion support, and is fixed proximal to a second end area of the exterior door grip situated on the opposite side of the first end area in the longitudinal direction of the vehicle on the door lock.

2. Opening arrangement according to claim 1, wherein the torsion support is fastened on the interior door shell by at least one supporting head.

3. Opening arrangement according to claim 2, wherein the torsion support is applied to the bearing bow eccentrically and on one side such that torsion forces onto the bearing bow because of a deformation of the exterior door shell can be transmitted without any torsion-caused deformation of the bearing bow to the torsion support and to the interior door shell.

4. Opening arrangement according to claim 3, wherein the torsion support is disposed on the bearing bow by a supporting section permitting at least two different supporting angles relative to the bearing bow.

5. Opening arrangement according to claim 2, wherein the torsion support is disposed on the bearing bow by means of a supporting section permitting at least two different supporting angles relative to the bearing bow.

6. Opening arrangement according to claim 2, wherein the torsion support is oriented to be inclined at least once in the space between the interior and exterior door shells.

7. Opening arrangement according to claim 1, wherein the torsion support is applied to the bearing bow eccentrically and on one side such that torsion forces onto the bearing bow because of a deformation of the exterior door shell can be transmitted without any torsion-caused deformation of the bearing bow to the torsion support and to the interior door shell.

8. Opening arrangement according to claim 7, wherein the torsion support is disposed on the bearing bow by a supporting section permitting at least two different supporting angles relative to the bearing bow.

9. Opening arrangement according to claim 8, wherein the torsion support has two supporting heads which are aligned with one another in a fork-type manner and of which one is provided for the arrangement of the torsion support in a left vehicle door and the other is provided for the arrangement in a right vehicle door.

10. Opening arrangement according to claim 1, wherein the torsion support is disposed on the bearing bow by a supporting section permitting at least two different supporting angles relative to the bearing bow.

11. Opening arrangement according to claim 10, wherein the torsion support has two supporting heads which are aligned with one another in a fork-type manner and of which one is provided for the arrangement of the torsion support in a left vehicle door and the other is provided for the arrangement in a right vehicle door.

12. Opening arrangement according to claim 1, wherein the torsion support is oriented to be inclined at least once in the space between the interior and exterior door shells.

13. Vehicle door and door lock assembly comprising:

a vehicle door including an exterior door shell and an interior door shell which are spaced from one another, an exterior door grip arranged outside of the exterior door shell, a bearing bow fixed to an interior side of the exterior door shell and operable to support the door grip and facilitate transfer of door unlocking movements between the door grip and a door lock adjacent a first position of the bearing bow, and a deformation resistant torsion support interposed between a second position of the bearing bow and the interior door shell, said deformation resistant support being configured and disposed to limit transfer of vehicle collision induced deformation of the exterior door shell to said second position of the bearing bow to thereby limit collision induced unlocking of the door.

14. Vehicle door and door lock assembly according to claim 13, wherein the torsion support is fastened on the interior door shell by at least one supporting head.

15. Vehicle door and door lock assembly according to claim 13, wherein the torsion support is applied to the bearing bow eccentrically and on one side such that torsion forces onto the bearing bow because of a deformation of the exterior door shell can be transmitted without any torsion-caused deformation of the bearing bow to the torsion support and to the interior door shell.

16. Vehicle door and door lock assembly according to claim 13, wherein the torsion support is disposed on the bearing bow by a supporting section permitting at least two different supporting angles relative to the bearing bow.

17. Vehicle door and door lock assembly according to claim 16, wherein the torsion support has two supporting heads which are aligned with one another in a fork-type manner and of which one is provided for the arrangement of the torsion support in a left vehicle door and the other is provided for the arrangement in a right vehicle door.

18. Vehicle door and door lock assembly according to claim 13, wherein the torsion support is a unitary one-piece member.

19. Vehicle door and door lock assembly according to claim 18, wherein the interior door shell includes a protruding supporting web engageable in an opening at one end of the one-piece member, and wherein the door shell includes a protruding support member engageable in an opening at an opposite end of the one-piece member.

* * * * *